US006402543B1

(12) United States Patent
Abe et al.

(10) Patent No.: US 6,402,543 B1
(45) Date of Patent: Jun. 11, 2002

(54) TERMINAL, AND CONNECTION STRUCTURE OF TERMINAL AND ELECTRIC WIRE

(75) Inventors: Kimihiro Abe; Nobuyuki Akeda, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/536,396

(22) Filed: Mar. 28, 2000

(30) Foreign Application Priority Data

Mar. 29, 1999 (JP) ..... 11-086980

(51) Int. Cl.[7] ..... H01R 4/24; H01R 4/26; H01R 11/20

(52) U.S. Cl. ..... 439/407; 439/877

(58) Field of Search ..... 439/407, 399, 439/401, 423, 424, 867, 868, 877, 878, 882

(56) References Cited

U.S. PATENT DOCUMENTS 2,794,964 A * 6/1957 Hoffman ..... 439/877
4,385,794 A * 5/1983 Lucius ..... 439/401
5,486,653 A * 1/1996 Dohi ..... 439/877
6,059,616 A * 5/2000 Bluemmel et al. ..... 439/867

FOREIGN PATENT DOCUMENTS

JP 60-57066 4/1985
JP 62-14598 4/1987

* cited by examiner

*Primary Examiner*—Brian Sircus
*Assistant Examiner*—Javid Nasri
(74) *Attorney, Agent, or Firm*—Finnegan, Henderson, Farabow, Garrett, & Dunner, L.L.P.

(57) ABSTRACT

A terminal has a base, a pair of caulking pieces integrally extending from the base, and a pair of bent pieces for regulating the movement of the electric wire. The caulking pieces are bent and retain the electric wire from over an insulating cladding thereof. The bent pieces integrally extend from the base and has an inclined surface contacting with the insulating cladding. The electric wire on the base is retained by the inclined surfaces and the caulking pieces at least from three directions. Accordingly, the lateral movement of the electric wire relative to the base when the terminal or the electric wire has been subjected to vibrations is regulated by bent pieces, whereby the impairment of the electric wire is prevented.

4 Claims, 4 Drawing Sheets

TERMINAL, AND CONNECTION STRUCTURE OF TERMINAL AND ELECTRIC WIRE

BACKGROUND OF THE INVENTION

The present invention relates to a terminal used on the connection thereto of an electric wire and a connection structure of the terminal and the electric wire.

Japanese Utility Model Application Laid-Open No. 60-57066 discloses a terminal. This terminal has a cladding-connecting portion that is shaped like a curved plate and that is intended to caulk an electric wire from over an insulating cladding thereof, and a protrusion on the cladding-connecting portion that is intended to regulate the position of the electric wire when performing caulking. The protrusion is obtained using a method of inwardly inverting a portion between two parallel cuts of the cladding-connecting portion or a method of pressing the cladding-connecting portion having no cuts therein by a pressing die.

SUMMARY OF THE INVENTION

However, in the conventional terminal, because the protrusion is bent from the cladding-connecting portion, the cladding-connecting portion becomes likely to be easily bent at a boundary portion between the cladding-connecting portion and the protrusion. As a result of this, there is the possibility that the cladding-connecting portion will be bent from the boundary portion without being curved as a whole and therefore the retaining force of the cladding-connecting portion with respect to the electric wire will decrease.

Thereupon, an object of the present invention is to provide a terminal that makes it possible to regulate the movement of the caulked electric wire without causing a decrease in the retaining force with respect to the electric wire.

To achieve the above object, a terminal according to a first aspect of the present invention has a base, a pair of caulking pieces that integrally extend from the base, and a pair of bent pieces for regulating the movement of the electric wire. The caulking pieces retain the electric wire from over the insulating cladding thereof be being bent. The respective bent pieces each integrally extend from the base and each have an inclined surface that contacts with the insulating cladding.

In this construction, the electric wire on the base is clamped between the inclined surfaces and the caulking piece and this electric wire is thereby retained at least from three directions. Accordingly, the lateral movement of the electric wire relative to the base when the terminal or the electric wire has been subjected to vibrations is regulated by the bent pieces. As a result, the electric wire is prevented from being impaired.

Also, since the bent pieces extend from the base, they do not have any effects upon the bending of the caulking pieces. Accordingly, the force of retaining the electric wire does not decrease due to the existence of the bent pieces.

A second aspect of the present invention is the one wherein in the first aspect of terminal the base has a bottom wall and a pair of side walls extending from both ends of the bottom wall and opposing each other. Each bent piece extends is bent from each corresponding side wall and extends toward the bottom wall.

A third aspect of the present invention is the one wherein in the first aspect of terminal the base has a bottom wall and a pair of side walls extending from both ends of the bottom wall and opposing each other. Each bent piece extends is bent from a central portion of the bottom wall and the respective bent pieces respectively extend toward the side walls.

A fourth aspect of the present invention is the one wherein in the third aspect of terminal the base has stoppers contacting with forward ends of the bent pieces in order to prevent the inclined surfaces thereof from being deformed toward the bottom wall.

DESCRIPTION OF THE PREFERRED EMBODIMENTS

An embodiment of a terminal and a connection structure thereof according to the present invention will now be explained.

First Embodiment

Figure 3A:
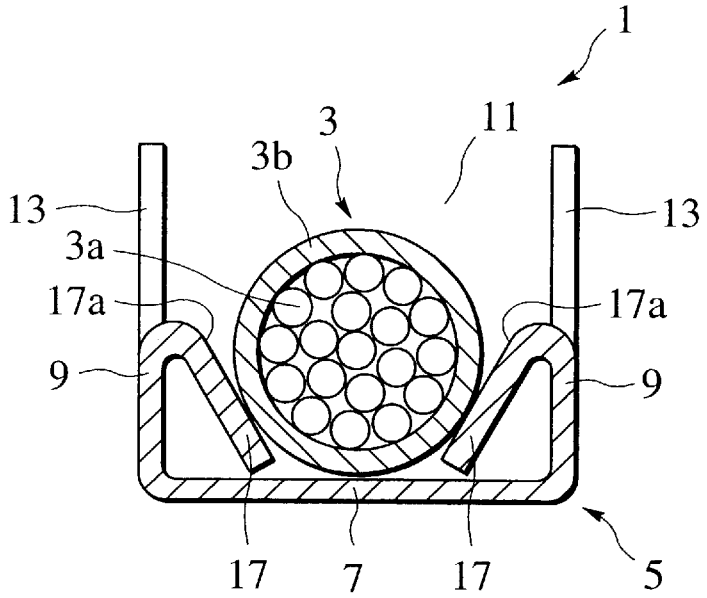
FIG. 3A is a sectional view illustrating an electric wire and terminal of FIG. 1 before caulking pieces are bent.

As illustrated in FIG. 3A, an electric wire 3 has a conductor (core wires) 3*a* and an insulating cladding 3*b* that has insulativity and that covers an outer periphery of the conductor 3*a*. At a terminal end of the electric wire 3, the conductor 3*a* is exposed from the insulating cladding 3*b*.

Figure 1:
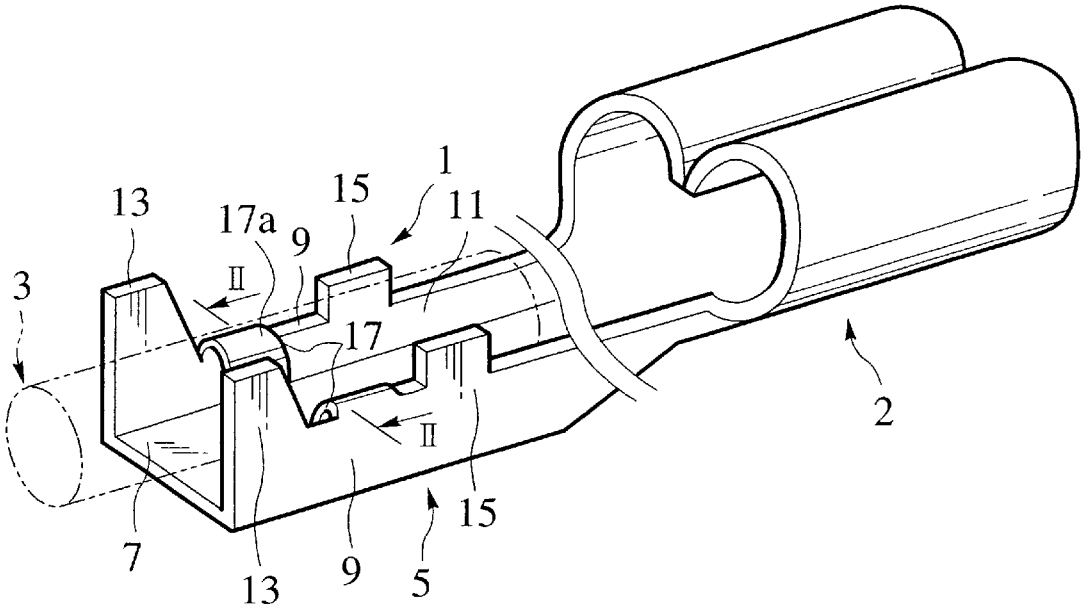
FIG. 1 is a perspective view illustrating a terminal according to a first embodiment.

As illustrated in FIG. 1, the terminal 1 is obtained by punching out a metal thin plate having electrical conductivity into a desired configuration and bending the resulting thin plate. The terminal 1 has at one end a contact portion 2 that can be fitted to a mating terminal and has at the other end a base 5, to that an end of the electric wire 3 is to be connected.

The base 5 has a bottom wall 7 on that the electric wire 3 is placed and a pair of side walls 9 bent from both ends of the bottom wall 7 and extending substantially in parallel with each other. The bottom wall 7 and the side walls 9 define an electric-wire accommodation space 11. The electric wire 3 having an outside diameter falling within a prescribed range corresponding to the width of the electric wire accommodation space 11 is connected to the terminal 1.

A pair of caulking pieces 13 caulking the electric wire 3 from over the insulating cladding 3*b* and a pair of conductor-connecting pieces caulking the exposed conductor 3*a* are extended from edges of the side walls 9.

Figure 2:
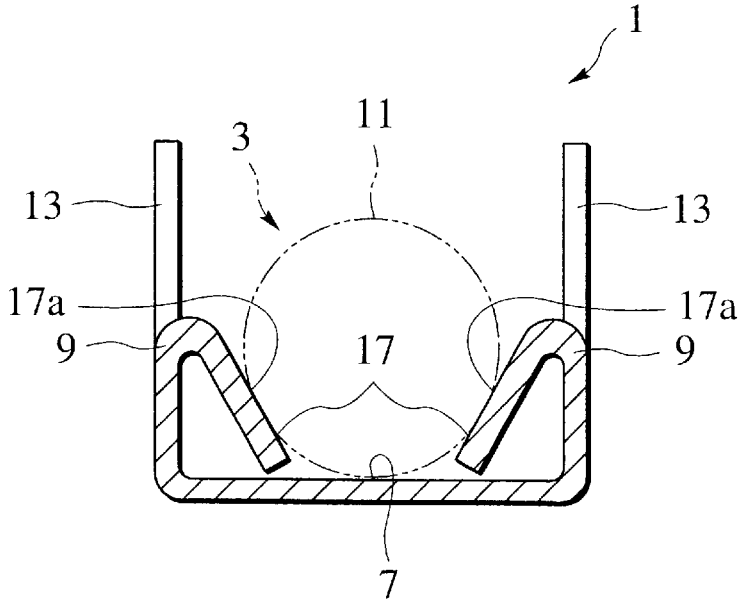
FIG. 2 is a sectional view taken along a line II—II of FIG. 1.

A pair of bent pieces 17 are respectively bent from the edges of the side walls 9 and are respectively extended through the electric wire accommodation space 11 toward the bottom wall 7. The bent piece 17 is disposed between the caulking piece 13 and the conductor-connecting piece 15. As illustrated in FIG. 2, the distance between the bent pieces 17 becomes gradually small toward the bottom wall 7 from the side wall 9 while the surfaces of the bent pieces 17 form inclined surfaces 17*a* extending from the side walls 9 toward the bottom wall 7. By the outer-peripheral surface of the insulating cladding 3*b* being contacted with the inclined surfaces 17*a,* there is regulated the lateral (the rightward/leftward direction in FIG. 2) of every electric wire 3 from the smallest diameter to the largest diameter, falling within the prescribed range. Forward ends of the bent pieces 17 are supported by their contact with the bottom wall 7.

Figure 3B:
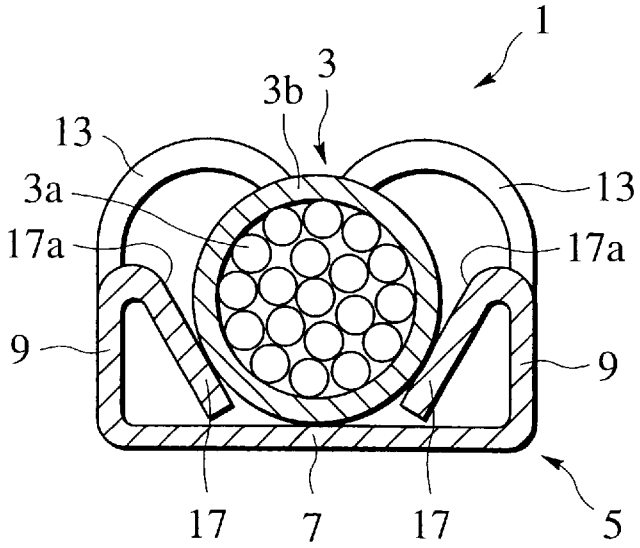
FIG. 3B is a sectional view illustrating the electric wire and terminal of FIG. 1 after the caulking pieces have been bent.

Next, the connection structure of the terminal and the electric wire will be explained with reference to FIGS. 3A and 3B.

When connecting the electric wire 3 to the terminal 1, first, as illustrated in FIG. 3A, the electric wire 3 is placed on the bottom wall 7 of the base 5. At this time, the outer-peripheral surface of the insulating cladding 3*b* is contacted with the inclined surfaces 17*a* of the bent pieces 17. And, as illustrated in FIG. 3B, the caulking pieces 13 are bent toward the bottom wall 7. As a result of this, the electric wire 3 is clamped by and among the caulking pieces 13, the bottom wall 7, and the inclined surfaces 17*a,* and this electric wire 3 is thereby retained at least from three directions.

Owing to the inclined surfaces 17*a* of the bent pieces 17, the retained electric wire 3 is situated substantially at a center portion as viewed in the width direction of the bottom wall 7, whereby the lateral movement of the electric wire 3 is regulated.

Accordingly, even when vibrations or the like has been applied to the base 5, the lateral movement of the electric wire 3 is prevented and, in addition, these vibrations or the like is absorbed by the insulating cladding 3*b* of the electric wire 3. Therefore, the impairment of the electric wire 3 due to the end edges of the caulking piece 13 is reliably prevented.

Further, the bent pieces 17 are extended from the base (the side walls 9). Therefore, the bent pieces 17 do not have any effects upon the bending of the caulking pieces 13. Accordingly, the retaining force of retaining the electric wire 3 by the caulking pieces 13 does not decrease due to the bent pieces 17.

Further, the both ends of the bent piece 17 are supported by the side wall 9 and the bottom wall 7. Therefore, even when the caulking pieces 13 are bent and as a result the electric wire 3 presses the bent pieces 17 with a high strength, the deformation of the bent pieces 17 is suppressed to a minimum extent. Therefore, the configuration of the inclined surfaces 17*a* is maintained as is. Accordingly, the increase in the retaining force of retaining the electric wire 3 by the caulking pieces 13 and the regulation of the lateral movement of the electric wire 3 due to the inclined surfaces 17*a* go together.

It is to be noted that the bent piece may be obtained by bending part of the bottom wall 7 toward the side wall 9.

Second Embodiment

Figure 4:
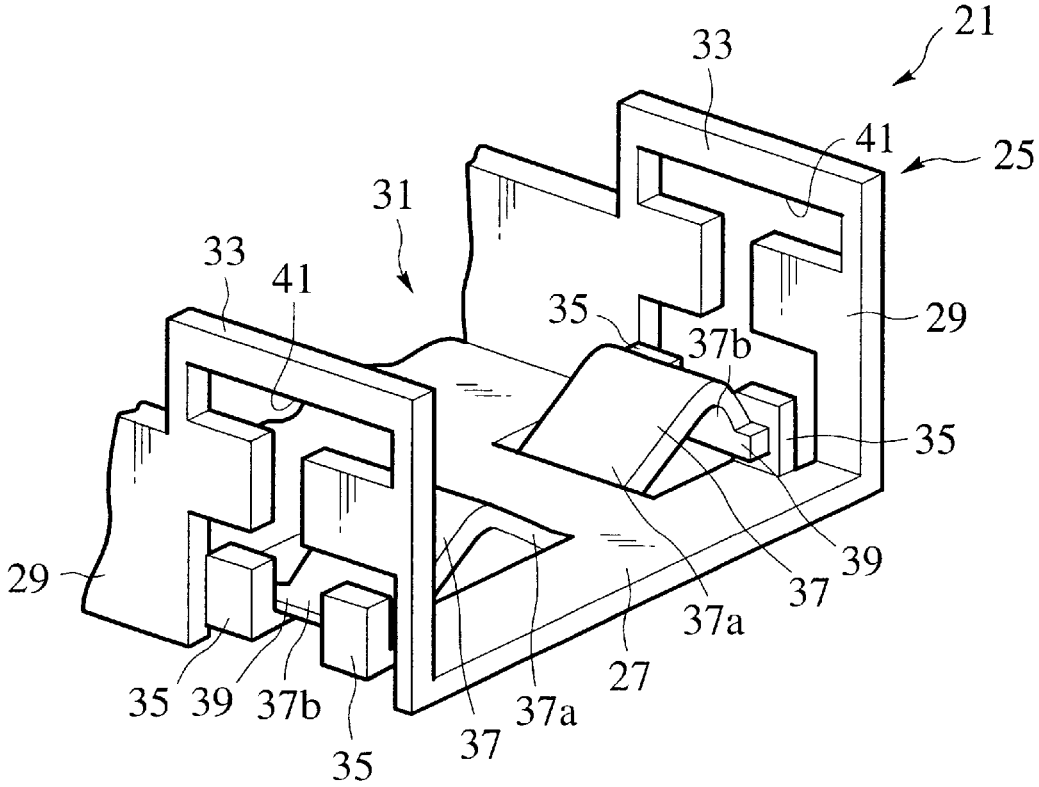
FIG. 4 is a perspective view illustrating a main portion of the terminal according to a second embodiment.
Figure 5:
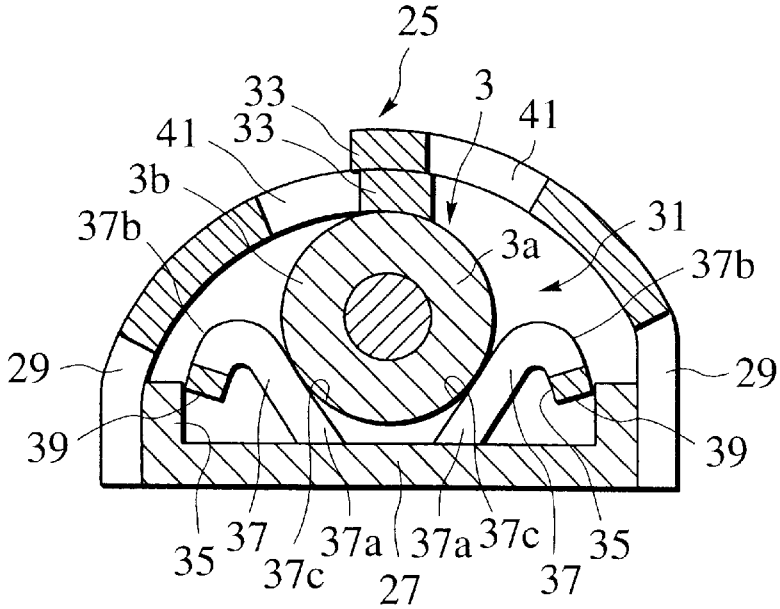
FIG. 5 is a sectional view illustrating the electric wire and terminal of FIG. 4 after the caulking pieces have been bent.

As illustrated in FIGS. 4 and 5, the base 25 of the terminal 21 has a bottom wall 27 on that the electric wire 3 is placed and a pair of side walls 29 bent from both ends of the bottom wall 27 and extending substantially in parallel with each other. The bottom wall 27 and the side walls 29 define the electric-wire accommodation space 31. The electric wire 3 having an outside diameter falling within a prescribed range corresponding to the width of the electric wire accommodation space 31 is connected to the terminal 21.

A pair of caulking pieces 33 for caulking the electric wire 3 from over the insulating cladding 3*b* and a pair of conductor-connecting pieces (not illustrated) for caulking the exposed conductor 3*a* are extended from the edges of the side walls 29.

A pair of bent pieces 37 are respectively raised by cutting from a central part of the bottom wall 27 and are respectively extended through the electric wire accommodation space 31 toward the side walls 29. The bent piece 37 is inclined with respect to each of the bottom wall 27 and side walls 29, and the bent pieces 37 are gradually separated from the bottom wall 27 in such a way as to extend from their base ends 37*a* toward their free ends 37*b.* As a result of this, the surfaces of the bent pieces 37 form the inclined surfaces 37*c* extending from the central part of the bottom wall 27 toward the side walls 29. By the outer-peripheral surface of the insulating cladding 3*b* being contacted with the inclined surfaces 37*c,* there is regulated the lateral (the rightward/leftward direction in FIG. 5) of every electric wire 3 from the smallest diameter to the largest diameter, falling within a prescribed range.

The free end 37*b* of the bent piece 37 is bent toward the bottom wall 27 and has protrusions 39 protruding from both ends as viewed in the lateral direction. Stoppers 35 are bent from both ends of the bottom wall 27 in the same direction as that in that the side walls 29 are extended. The stoppers 35 are disposed inside the side walls 29 and are contacted with protrusions 39 of the bent pieces 37. As a result of this, excessive deformation of the bent pieces 37 is prevented.

Figure 6:
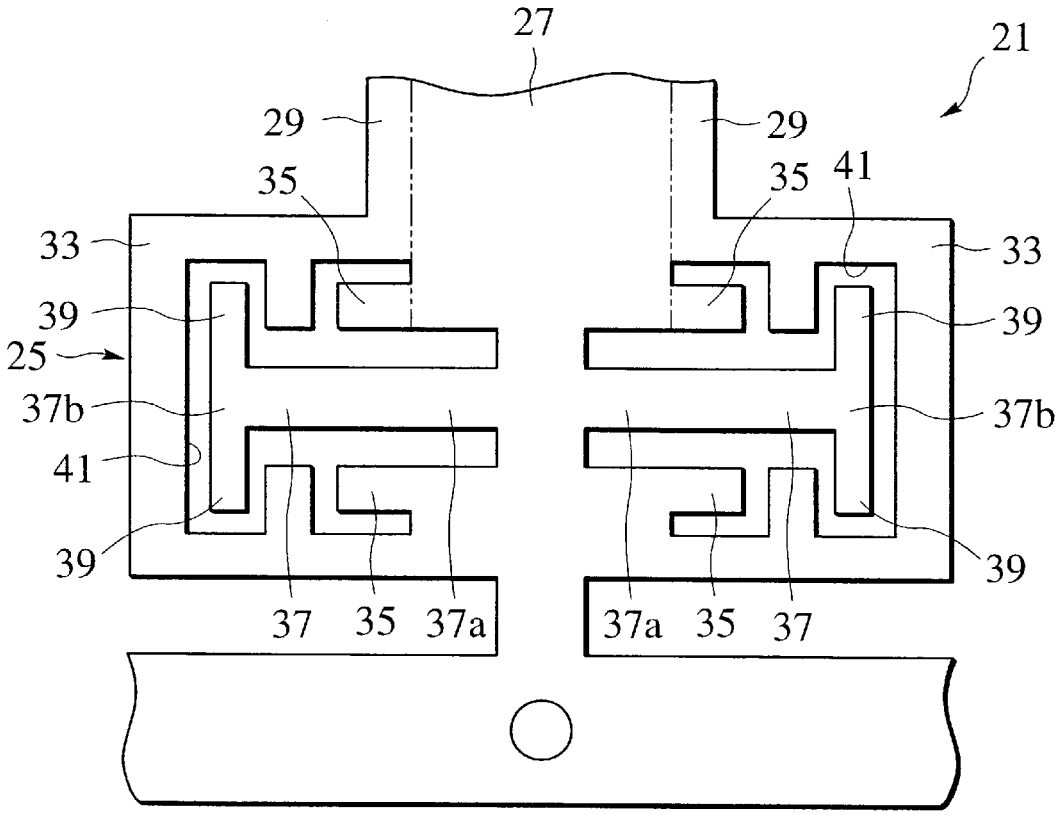
FIG. 6 is a plan view illustrating the terminal of FIG. 4 that has been developed.

As illustrated in FIG. 6, the terminal 21 in a state of its having been punched out from a metal plate has through holes 41 for defining the bent pieces 37 and the stoppers 35.

When connecting the electric wire 3 to the terminal 1, first, the electric wire 3 is placed on the bottom wall 27 of the base 25. At this time, the outer-peripheral surface of the insulating cladding 3*b* is contacted with the inclined surfaces 37*c* of the bent pieces 37. And, the caulking pieces 33 are bent toward the bottom wall 27. As a result of this, the electric wire 3 is clamped by and among the caulking pieces 33, and the inclined surfaces 37*c,* and this electric wire 3 is thereby retained at least from three directions.

Owing to the inclined surfaces 37*c* of the bent pieces 37, the retained electric wire 3 is situated substantially at a center portion as viewed in the width direction of the bottom wall 2, whereby the lateral movement of the electric wire 3 is regulated.

Accordingly, even when vibrations or the like has been applied to the base 25, the lateral movement of the electric wire 3 is prevented and, in addition, these vibrations or the like is absorbed by the insulating cladding 3*b* of the electric wire 3. Therefore, the impairment of the electric wire 3 due to the end edges of the caulking piece 33 is reliably prevented.

Further, the bent pieces 37 are extended from the base 25 (the side walls 27). Therefore, the bent pieces 37 do not have any effects upon the bending of the caulking pieces 33. Accordingly, the retaining force of retaining the electric wire 3 by the caulking pieces 33 does not decrease due to the bent pieces 37.

Further, the both ends of the bent piece 37 are supported by the bottom wall 27 and the stopper 35. Therefore, even when the caulking pieces 33 are bent and as a result the electric wire 3 presses the bent pieces 37 with a high strength, the deformation of the bent pieces 37 is suppressed to a minimum extent. Therefore, the configuration of the inclined surfaces 37*c* is maintained as is. Accordingly, the increase in the retaining force of retaining the electric wire 3 by the caulking pieces 33 and the regulation of the lateral movement of the electric wire 3 due to the inclined surface 37*c* go together.

What is claimed is:

1. A terminal for an electric wire having an insulating cladding, the terminal comprising:

a base having a bottom wall and a pair of side walls extending from both ends of the bottom wall and opposing each other;

a pair of caulking pieces integrally extending from the side walls, the caulking pieces being bent and having end edges for retaining the electric wire by contacting the insulating cladding; and a pair of bent pieces for regulating movement of the electric wire, the bent pieces integrally extending from ends of the side walls toward the bottom wall and having inclined surfaces facing away from the bottom wall for contacting the insulating cladding.

2. The terminal according to claim 1, wherein forward ends of the respective bent pieces are supportable by the bottom wall.

3. The terminal according to claim 1, further comprising a contact portion for making a contact with a mating terminal.

4. A connection structure comprising:

an electric wire having an insulating cladding; and a terminal comprising:

a base having a bottom wall and a pair of side walls extending from both ends of the bottom wall and opposing each other;

a pair of caulking pieces integrally extending from the side walls, the caulking pieces being bent and having end edges for retaining the electric wire by contacting the insulating cladding; and a pair of bent pieces for regulating movement of the electric wire, the bent pieces integrally extending from ends of the side walls toward the bottom wall and having inclined surfaces facing away from the bottom wall for contacting the insulating cladding.

* * * * *